US010830451B2

(12) United States Patent
Cadima

(10) Patent No.: US 10,830,451 B2
(45) Date of Patent: Nov. 10, 2020

(54) BOOSTED GAS BURNER ASSEMBLY AND A METHOD OF OPERATING THE SAME

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 296 days.

(21) Appl. No.: 15/949,139

(22) Filed: Apr. 10, 2018

(65) Prior Publication Data

US 2019/0309953 A1 Oct. 10, 2019

(51) Int. Cl.

| | |
|---|---|
| ***F24C 3/12*** | (2006.01) |
| ***F23D 14/22*** | (2006.01) |
| ***F23D 14/34*** | (2006.01) |
| ***F23D 14/36*** | (2006.01) |
| ***F23C 5/08*** | (2006.01) |
| ***F23L 5/02*** | (2006.01) |

(52) U.S. Cl.

CPC ..... *F24C 3/122* (2013.01); *F23C 5/08* (2013.01); *F23D 14/22* (2013.01); *F23D 14/36* (2013.01); *F23L 5/02* (2013.01)

(58) Field of Classification Search

CPC ..... F23D 2900/14062; F23D 14/02; F23D 14/06; F23D 2900/00008; F23D 2900/14063; F23D 14/34; F23D 14/36; F23N 1/002; F23N 2235/30; F23N 2237/10; F23N 2241/08; F23N 1/00; F23N 1/02; F23N 1/04; F23N 1/10; F23N 3/00; F23N 2900/05181; F23L 5/02; F23L 7/007; F23K 1/00; F23K 5/00; F23K 5/002; F23K 5/007; F23K 5/02; F23K 2900/05002

USPC ..... 431/12, 284, 354; 126/39 E, 15 R, 15 A

See application file for complete search history.

(56) References Cited

U.S. PATENT DOCUMENTS

| | | | | |
|---|---|---|---|---|
| 4,059,386 | A * | 11/1977 | Eising | F23Q 9/14 431/43 |
| 6,322,354 | B1 | 11/2001 | Carbone et al. | |
| 8,845,326 | B2 | 9/2014 | Shaffer et al. | |
| 2013/0344446 | A1* | 12/2013 | Barritt | F23N 5/242 431/6 |
| 2017/0108226 | A1* | 4/2017 | Moon | F23L 9/00 |

FOREIGN PATENT DOCUMENTS

| | | |
|---|---|---|
| CN | 103900103 B | 1/2016 |

* cited by examiner

*Primary Examiner* — Vivek K Shirsat
*Assistant Examiner* — Ko-Wei Lin
(74) *Attorney, Agent, or Firm* — Dority & Manning, P.A.

(57) ABSTRACT

A gas burner assembly for a cooktop appliance and a method for operating the same are provided. The gas burner assembly includes a normally aspirated primary burner, a concentrically-positioned forced air boost burner, a boost valve for regulating a flow of boost fuel to the boost burner, and a forced air supply source for providing a flow of air to the boost burner. The method includes activating the boost burner upon receiving a command and starting a timer. After a predetermined amount of time has passed, e.g., such as ten minutes, the boost burner is extinguished by closing the boost valve to prevent unsafe operating conditions.

19 Claims, 8 Drawing Sheets

BOOSTED GAS BURNER ASSEMBLY AND A METHOD OF OPERATING THE SAME

FIELD OF THE INVENTION

The present subject matter relates generally to cooktop appliances and more particularly to gas burner assemblies for cooktop appliances and associated methods of operation.

BACKGROUND OF THE INVENTION

Gas burners are commonly used on the cooktops of household gas cooking appliances including e.g., range ovens and cooktop appliances built into cabinetry. For example, gas cooktops traditionally have at least one gas burner positioned at a cooktop surface for use in heating or cooking an object, such as a cooking utensil and its contents. Gas burners generally include an orifice that directs a flow of gaseous fuel into a fuel chamber. Between the orifice and the fuel chamber, the gaseous fuel entrains air, and the gaseous fuel and air mix within the fuel chamber before being ignited and discharged out of the fuel chamber through a plurality of flame ports.

Normally aspirated gas burners rely on the energy available in the form of pressure from the fuel supplied to the gas burner to entrain air for combustion. Because the nominal pressure in households is relatively low, there is a practical limit to the amount of primary air a normally aspirated gas burner can entrain. Introducing a fan or another forced air supply into a gas burner assembly may improve the mixture of fuel and air for improved operation at higher outputs, with shorter flames and improved combustion, and with improved efficiency.

In general, there is a trend in the cooking appliance market toward high-powered forced air burners in order to speed up cooking tasks. However, while higher powered burners offer very fast cooking times, that can also more quickly overheat food and/or the appliance itself if operated for excessive periods of time. A user that is accustomed only to older, less capable appliances may underestimate the power of newer, higher powered burners, resulting in poor cooking performance and/or overheating.

Accordingly, a cooktop appliance including an improved gas burner with forced aeration would be desirable. More particularly, a gas burner assembly that offers extremely high rates of heating in a safe and controlled manner that reduces the potential for overheating would be particularly beneficial.

BRIEF DESCRIPTION OF THE INVENTION

Aspects and advantages of the invention will be set forth in part in the following description, or may be apparent from the description, or may be learned through practice of the invention.

In a first example embodiment, a gas burner assembly for a cooktop appliance is provided. The gas burner assembly includes a primary burner including a plurality of primary flame ports in fluid communication with a primary fuel chamber for receiving a flow of primary fuel and a boost burner including a plurality of boost burner ports in fluid communication with a boost fuel chamber for receiving a flow of boost fuel. A boost valve regulates the flow of boost fuel to the boost fuel chamber and a forced air supply source selectively urges a flow of air into the boost fuel chamber. A controller is operably coupled to the boost valve and the forced air supply source, the controller being configured for:

receiving a command to activate the boost burner; activating the boost burner upon receiving the command to activate the boost burner; and extinguishing the boost burner when a predetermined amount of time has passed since activating the boost burner.

In a second example embodiment, a method for operating a gas burner assembly is provided. The gas burner assembly includes a primary burner positioned concentrically below a boost burner, a boost valve for regulating a flow of boost fuel to a boost fuel chamber, and a forced air supply source for selectively urging a flow of air into the boost fuel chamber. The method includes receiving a command to activate the boost burner; activating the boost burner upon receiving the command to activate the boost burner; and extinguishing the boost burner when a predetermined amount of time has passed since activating the boost burner.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
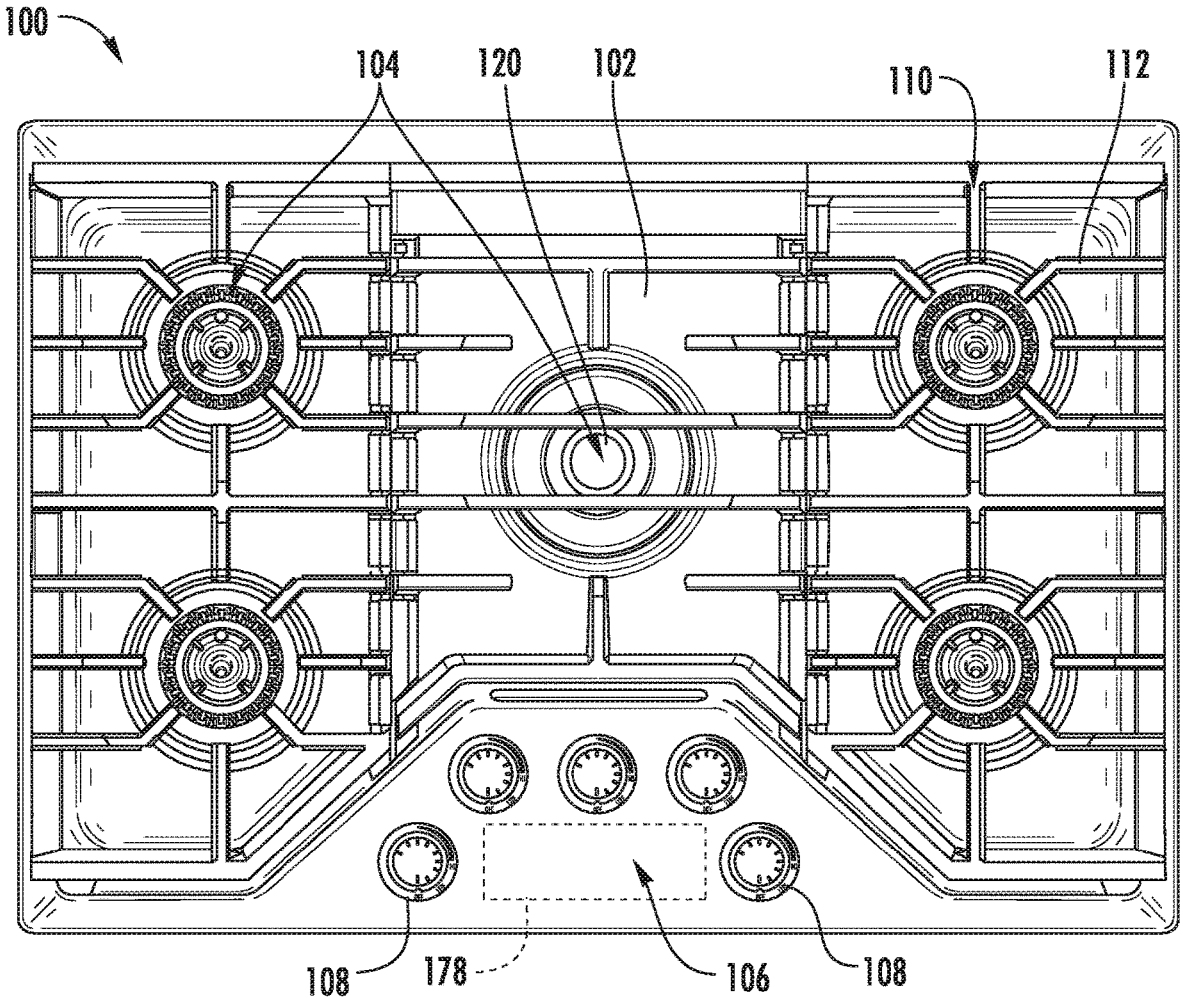
FIG. 1 provides a top view of a cooktop appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a gas burner assembly for a cooktop appliance 100. Although cooktop appliance 100 is used below for the purpose of explaining the details of the present subject matter, it should be appreciated that the present subject matter may apply to any other suitable consumer or commercial appliance. For example, the exemplary gas burner assemblies described below may be used on other types of cooking appliances, such as ranges or oven appliances. Cooktop appliance 100 is used in the discussion below only for the purpose of explanation, and such use is not intended to limit the scope of the present disclosure in any manner.

FIG. 1 illustrates an exemplary embodiment of a cooktop appliance 100 of the present disclosure. Cooktop appliance 100 may be, e.g., fitted integrally with a surface of a kitchen counter, may be configured as a slide-in cooktop unit, or may be a part of a free-standing range cooking appliance. Cooktop appliance 100 includes a top panel 102 that includes one or more heating sources, such as heating elements 104 for use in, e.g., heating or cooking. Top panel 102, as used herein, refers to any upper surface of cooktop appliance 100 on which utensils may be heated and therefore food cooked. In general, top panel 102 may be constructed of any suitably rigid and heat resistant material capable of supporting heating elements 104, cooking utensils, and/or other components of cooktop appliance 100. By way of example, top panel 102 may be constructed of enameled steel, stainless steel, glass, ceramics, and combinations thereof.

According to the illustrated exemplary embodiment, a user interface panel or control panel 106 is located within convenient reach of a user of cooktop appliance 100. For this exemplary embodiment, control panel 106 includes control knobs 108 that are each associated with one of heating elements 104. Control knobs 108 allow the user to activate each heating element 104 and regulate the amount of heat input each heating element 104 provides to a cooking utensil located thereon, as described in more detail below. Although cooktop appliance 100 is illustrated as including control knobs 108 for controlling heating elements 104, it should be understood that control knobs 108 and the configuration of cooktop appliance 100 shown in FIG. 1 is provided by way of example only. More specifically, control panel 106 may include various input components, such as one or more of a variety of touch-type controls, electrical, mechanical or electro-mechanical input devices including rotary dials, push buttons, and touch pads.

According to the illustrated embodiment, control knobs 108 are located within control panel 106 of cooktop appliance 100. However, it should be appreciated that this location is used only for the purpose of explanation, and that other locations and configurations of control panel 106 and control knobs 108 are possible and within the scope of the present subject matter. Indeed, according to alternative embodiments, control knobs 108 may instead be located directly on top panel 102 or elsewhere on cooktop appliance 100, e.g., on a backsplash, front bezel, or any other suitable surface of cooktop appliance 100. Control panel 106 may also be provided with one or more graphical display devices, such as a digital or analog display device designed to provide operational feedback to a user.

According to the illustrated embodiment, cooktop appliance 100 is a gas cooktop and heating elements 104 are gas burners, such as a gas burner assembly 120 described below. As illustrated, heating elements 104 are positioned within top panel 102 and have various sizes, as shown in FIG. 1, so as to provide for the receipt of cooking utensils (i.e., pots, pans, etc.) of various sizes and configurations and to provide different heat inputs for such cooking utensils. In addition, cooktop appliance 100 may include one or more grates 110 configured to support a cooking utensil, such as a pot, pan, etc. In general, grates 110 include a plurality of elongated members 112, e.g., formed of cast metal, such as cast iron. The cooking utensil may be placed on the elongated members 112 of each grate 110 such that the cooking utensil rests on an upper surface of elongated members 112 during the cooking process. Heating elements 104 are positioned underneath the various grates 110 such that heating elements 104 provide thermal energy to cooking utensils above top panel 102 by combustion of fuel below the cooking utensils.

Figure 2:
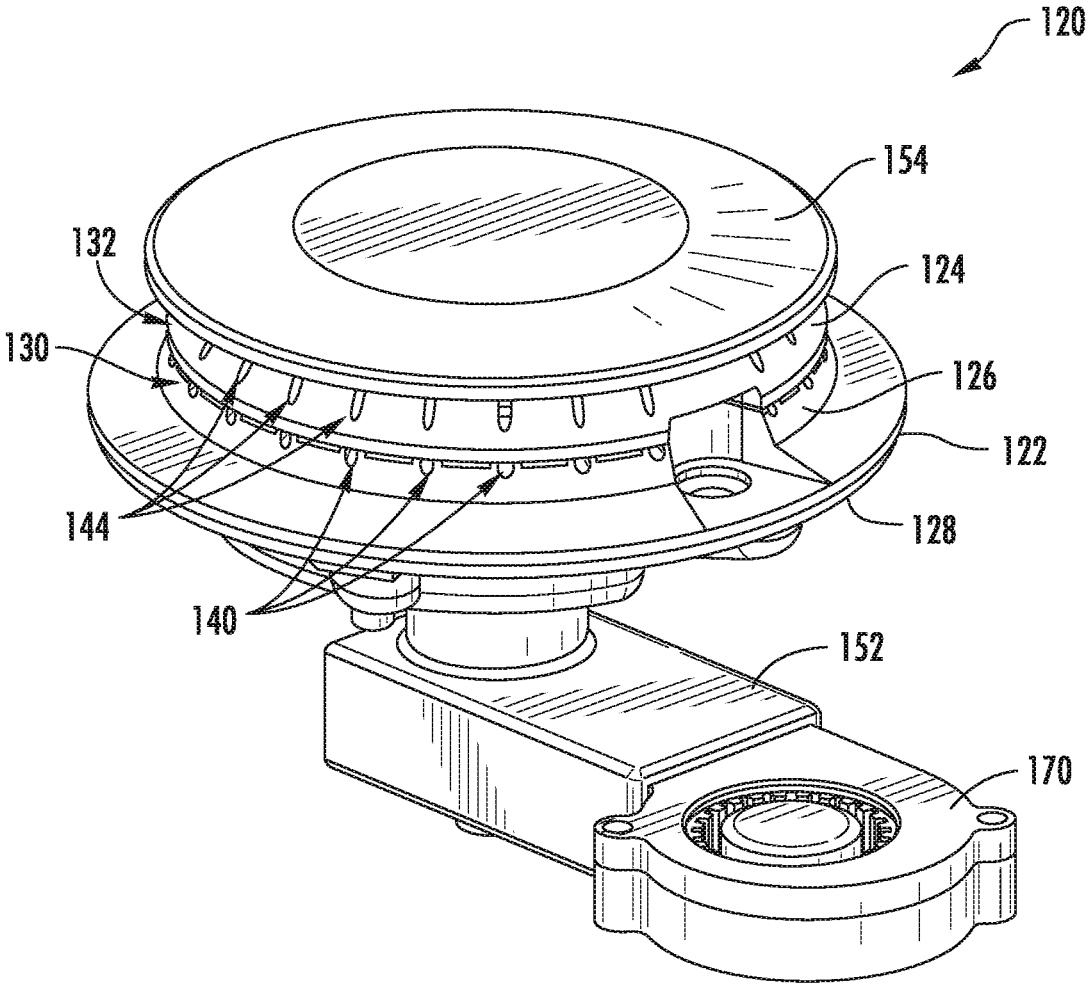
FIG. 2 provides a perspective view of a gas burner assembly of the exemplary cooktop appliance of FIG. 1 according to an exemplary embodiment of the present subject matter.
Figure 3:
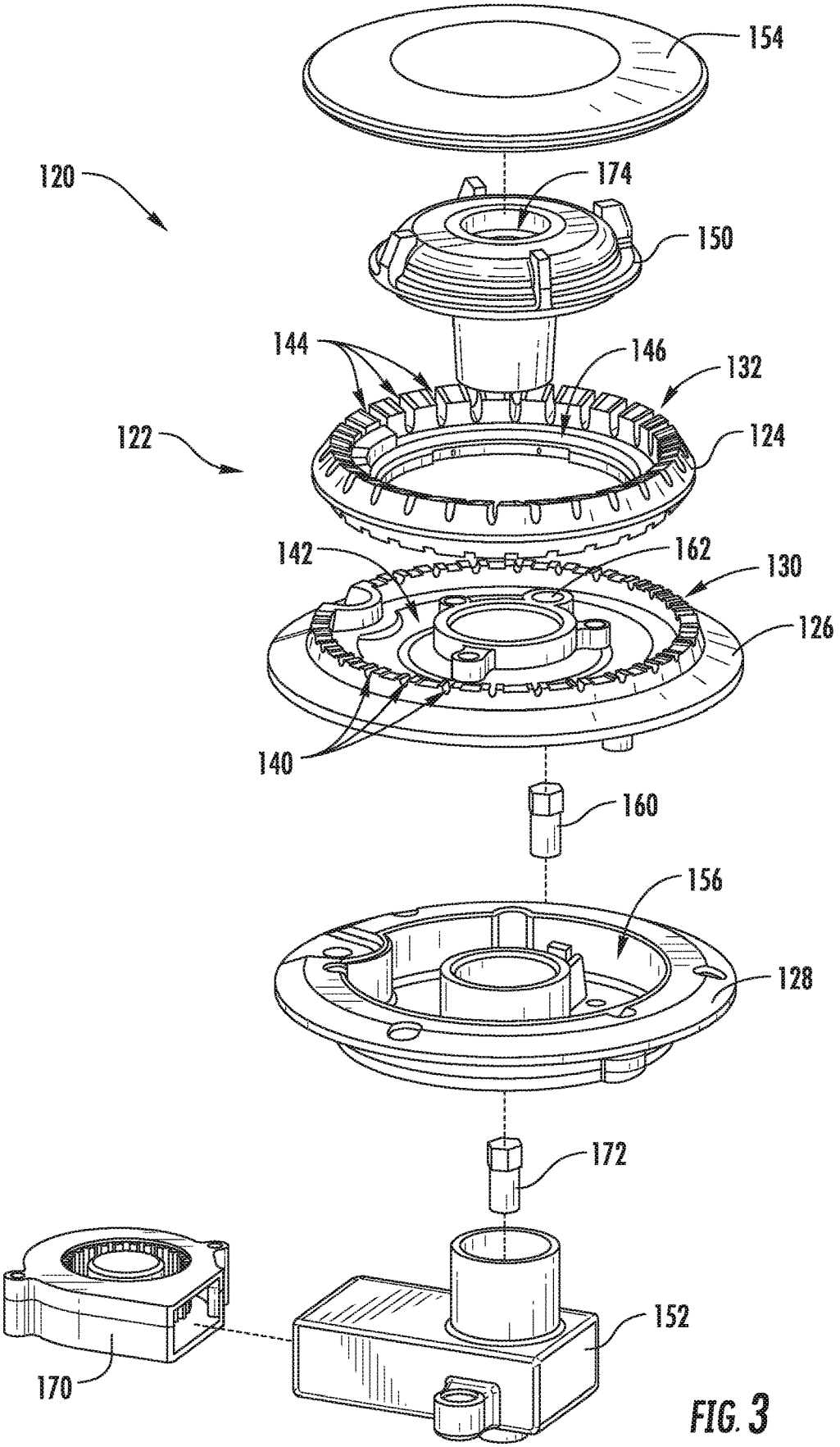
FIG. 3 is an exploded view of the example gas burner of FIG. 2.
Figure 4:
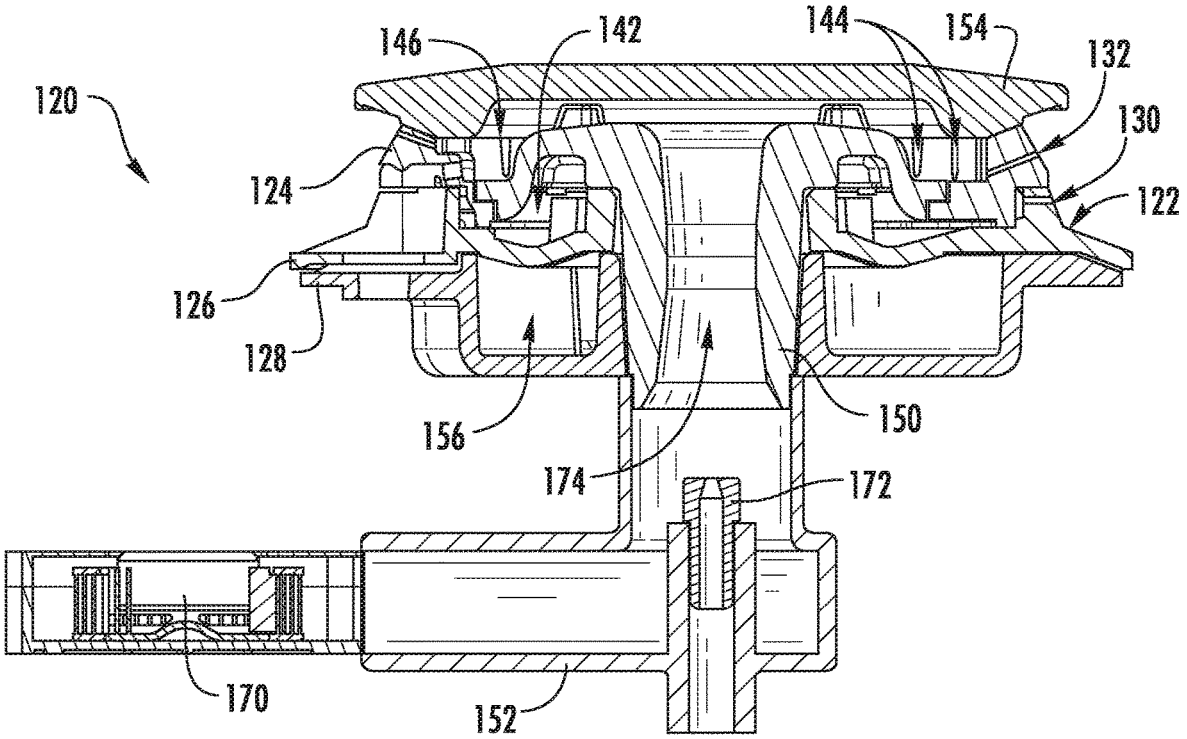
FIG. 4 is a section view of the example gas burner of FIG. 2.
Figure 5:
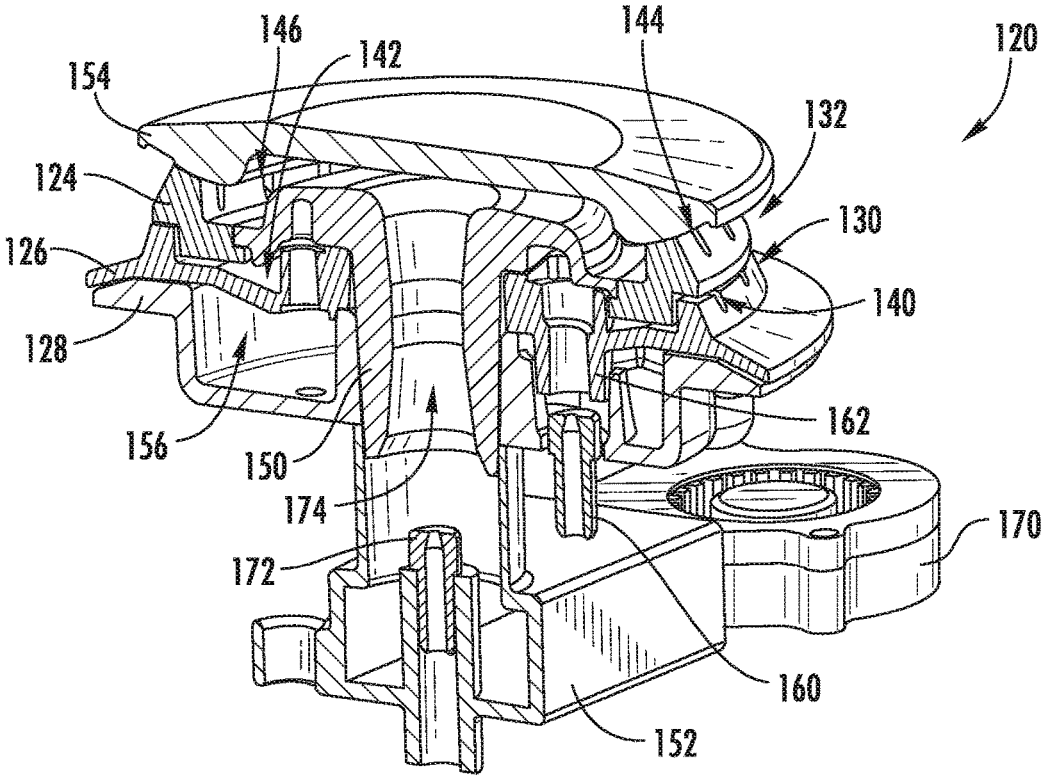
FIG. 5 is another section view of the example gas burner of FIG. 2.

FIG. 2 is a perspective view of gas burner assembly 120. FIG. 3 is an exploded view of gas burner assembly 120. FIG. 4 is a section view of the gas burner assembly 120, and FIG. 5 is another section view of gas burner assembly 120. As an example, burner assembly 120 may be used in cooktop appliance 100 (FIG. 1) as one of heating elements 104. However, it will be understood that, while described in greater detail below in the context of cooktop appliance 100, gas burner assembly 120 may be used in or with any suitable appliance in alternative example embodiments.

As may be seen in FIGS. 2 through 5, gas burner assembly 120 includes one or more burner bodies 122, which may include for example, a first burner body 124, a second burner body 126, and a third burner body 128. Burner bodies 122 generally define a first burner ring or stage (e.g., a primary burner 130) and a second burner ring or stage (e.g., a boost burner 132). More specifically, primary burner 130 generally includes a plurality of primary flame ports 140 and a primary fuel chamber 142 which are defined by first burner body 124 and second burner body 126. Similarly, boost burner 132 generally includes a plurality of boost flame ports 144 and a boost fuel chamber 146 which are defined at least in part by first burner body 124.

Gas burner assembly 120 may also include an air duct 150, a manifold 152, and a cap 154. Primary flame ports 140 may be defined on second burner body 126, e.g., at a circular outer wall of second burner body 126. Similarly, boost flame ports 144 may be defined on first burner body 124, e.g., at a circular outer wall of first burner body 124. Boost fuel chamber 146 may be defined by inner surfaces of cap 154, air duct 150, and first burner body 124. Primary fuel chamber 142 may be defined by inner surfaces of air duct 150, first burner body 124, and second burner body 126. Primary fuel chamber 142 is separate or independent from boost fuel chamber 146 within gas burner assembly 120. Thus, primary fuel chamber 142 is not in flow communication with boost fuel chamber 146 within gas burner assembly 120. In addition, an air chamber 156 may be defined by second burner body 126 and third burner body 128.

According to the exemplary illustrated embodiment, primary burner 130 is a normally aspirated burner that relies on the energy available in the form of pressure from the fuel supplied to the gas burner to entrain air for combustion. In this regard, for example, as best shown in FIGS. 3 and 5 a first orifice 160 is positioned at, e.g., directly below and/or concentric with, a Venturi inlet passage 162 on second burner body 126. Venturi inlet passage 162 is in fluid communication with primary fuel chamber 142. Thus, gaseous fuel from first orifice 160 may flow into primary fuel chamber 142 through Venturi inlet passage 162. From primary fuel chamber 142, the mixture of gaseous fuel and air may flow through and be combusted at primary flame ports 140. Thus, primary flame ports 140 are in fluid communication with primary fuel chamber 142 such that the mixture of gaseous fuel and air within primary fuel chamber 142 is flowable through primary flame ports 140. Venturi inlet passage 162 assists with naturally aspirating primary burner 130. For example, Venturi inlet passage 162 may increase a speed and/or decrease a pressure of gaseous fuel flowing from first orifice 160 such that Venturi inlet passage 162 entrains air from air chamber 156 into Venturi inlet passage 162.

By contrast, boost burner 132 is a forced air burner that uses supplemental air from a forced air supply source to facilitate combustion. In this regard, for example, as illustrated in FIGS. 2 through 5, the forced air supply source is provided by a fan 170. Although illustrated as fan 170, it should be appreciated that the forced air supply source may be any other device suitable for urging a flow of combustion air, such as an air pump, or an air compressor.

As illustrated, fan 170 is mounted directly to manifold 152. Thus, e.g., fan 170 is operable to urge air into manifold 152. A second orifice 172 is also mounted to manifold 152. Thus, gaseous fuel from second orifice 172 may flow into manifold 152 and mix with air from fan 170. Manifold 152 also extends to air duct 150. A passage 174 of air duct 150 extends from manifold 152 to boost fuel chamber 146. Thus, the mixture of gaseous fuel and air from manifold 152 may flow through passage 174 of air duct 150 to boost fuel chamber 146. Second orifice 172 may be positioned directly below and/or concentric with passage 174 of air duct 150. From boost fuel chamber 146, the mixture of gaseous fuel and air may flow through and be combusted at boost flame ports 144. Thus, boost flame ports 144 are in fluid communication with boost fuel chamber 146 such that the mixture of gaseous fuel and air within boost fuel chamber 146 is flowable through boost flame ports 144. As may be seen from the above, fan 170 may be coupled to gas burner assembly 120 such that fan 170 is operable to urge a flow of air 176 (see, e.g., FIGS. 7 and 8) into only boost fuel chamber 146, and fan 170 may provide air to boost fuel chamber 146 for forced aspiration of boost burner 132.

As may be seen in FIGS. 2 through 4, primary flame ports 140 may be positioned concentric with boost flame ports 144. Further, primary flame ports 140 (and primary burner 130) may be positioned below boost flame ports 144 (and boost burner 132). Such positioning of primary burner 130 relative to boost burner 132 may improve combustion of gaseous fuel when control knob 108 is in the boost position. For example, flames at primary burner 130 may assist with lighting gaseous fuel at boost burner 132 when control knob 108 is in the boost position due to the position of primary burner 130 below boost burner 132.

Operation of cooktop appliance 100 and gas burner assemblies 120 may be controlled by electromechanical switches or by a controller or processing device 178 (FIGS. 1 and 6) that is operatively coupled to control panel 106 for user manipulation, e.g., to control the operation of heating elements 104. In response to user manipulation of control panel 106 (e.g., via control knobs 108 and/or a touch screen interface), controller 178 operates the various components of cooktop appliance 100 to execute selected instructions, commands, or other features.

As described in more detail below with respect to FIG. 6, controller 178 may include a memory and microprocessor, such as a general or special purpose microprocessor operable to execute programming instructions or micro-control code associated with appliance operation. Alternatively, controller 178 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 106 and other components of cooktop appliance 100 may be in communication with controller 178 via one or more signal lines or shared communication busses.

Figure 6:
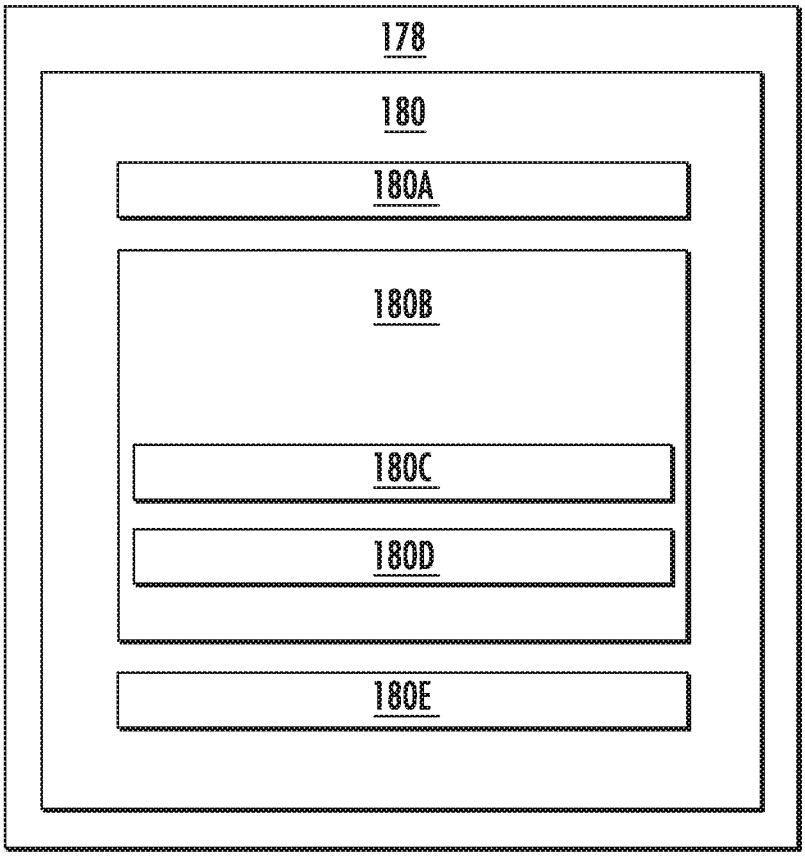
FIG. 6 depicts certain components of a controller according to example embodiments of the present subject matter.

FIG. 6 depicts certain components of controller 178 according to example embodiments of the present disclosure. Controller 178 can include one or more computing device(s) 180 which may be used to implement methods as described herein. Computing device(s) 180 can include one or more processor(s) 180A and one or more memory device(s) 180B. The one or more processor(s) 180A can include any suitable processing device, such as a microprocessor, microcontroller, integrated circuit, an application specific integrated circuit (ASIC), a digital signal processor (DSP), a field-programmable gate array (FPGA), logic device, one or more central processing units (CPUs), graphics processing units (GPUs) (e.g., dedicated to efficiently rendering images), processing units performing other specialized calculations, etc. The memory device(s) 180B can include one or more non-transitory computer-readable storage medium(s), such as RAM, ROM, EEPROM, EPROM, flash memory devices, magnetic disks, etc., and/or combinations thereof.

The memory device(s) 180B can include one or more computer-readable media and can store information accessible by the one or more processor(s) 180A, including instructions 180C that can be executed by the one or more processor(s) 180A. For instance, the memory device(s) 180B can store instructions 180C for running one or more software applications, displaying a user interface, receiving user input, processing user input, etc. In some implementations, the instructions 180C can be executed by the one or more processor(s) 180A to cause the one or more processor(s) 180A to perform operations, e.g., such as one or more portions of methods described herein. The instructions 180C can be software written in any suitable programming language or can be implemented in hardware. Additionally, and/or alternatively, the instructions 180C can be executed in logically and/or virtually separate threads on processor(s) 180A.

The one or more memory device(s) 180B can also store data 180D that can be retrieved, manipulated, created, or stored by the one or more processor(s) 180A. The data 180D can include, for instance, data to facilitate performance of methods described herein. The data 180D can be stored in one or more database(s). The one or more database(s) can be connected to controller 178 by a high bandwidth LAN or WAN, or can also be connected to controller through network(s) 184. The one or more database(s) can be split up so that they are located in multiple locales. In some implementations, the data 180D can be received from another device.

The computing device(s) 180 can also include a communication module or interface 180E used to communicate with one or more other component(s) of controller 178 or cooktop appliance 100 over the network(s) 184. The communication interface 180E can include any suitable components for interfacing with one or more network(s), including for example, transmitters, receivers, ports, controllers, antennas, or other suitable components.

Figure 7:
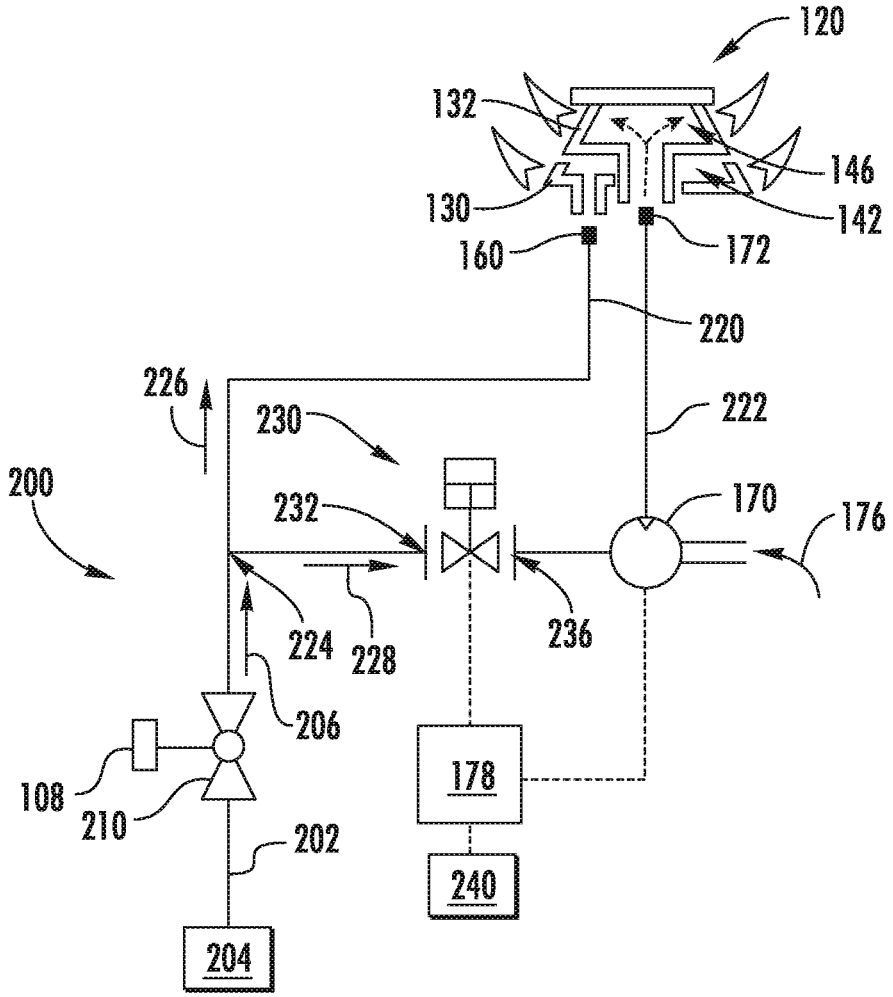
FIG. 7 is a schematic view of a gas burner assembly and a fuel supply system according to an example embodiment of the present subject matter.

Referring now to FIG. 7, a schematic view of gas burner assembly 120 and a fuel supply system 200 will be described. In general, fuel supply system 200 is configured for selectively supplying gaseous fuel such as propane or natural gas to primary burner 130 and boost burner 132 to regulate the amount of heat generated by the respective stages. In particular, fuel supply system 200 is configured for selectively supplying gaseous fuel to only primary burner 130 or to both primary burner 130 and boost burner 132 depending upon the desired output of gas burner assembly 120 selected by a user of gas burner assembly 120. Thus, primary burner 130 is separate or independent from boost burner 132, e.g., such that primary burner 130 is not in fluid communication with boost burner 132 within gas burner assembly 120. In such manner, gaseous fuel within gas burner assembly 120 does not flow between primary burner 130 and boost burner 132.

As shown in FIG. 7, fuel supply system 200 includes a supply line 202 that may be coupled to a pressurized gaseous fuel source 204, such as a natural gas supply line or a propane tank. In this manner, a flow of supply fuel (indicated by arrow 206), such as gaseous fuel (e.g., natural gas or propane), is flowable from the pressurized gaseous fuel source 204 into supply line 202. Fuel supply system 200 further includes a control valve 210 operably coupled to supply line 202 for selectively directing a metered amount of fuel to primary burner 130 and boost burner 132.

More specifically, according to an exemplary embodiment, control knob 108 may be operably coupled to control valve 210 for regulating the flow of supply fuel 206. In this regard, a user may rotate control knob 108 to adjust the position of control valve 210 and the flow of supply fuel 206 through supply line 202. In particular, gas burner assembly 120 may have a respective heat output at each position of control knob 108 (and control valve 210), e.g., an off, high, medium, and low position. In addition, control knob 108 may be rotated to a lite position to supply a suitable amount of gaseous fuel to primary burner 130 for ignition, which may be simultaneously achieved using, e.g., a spark electrode (not shown).

Figure 8:
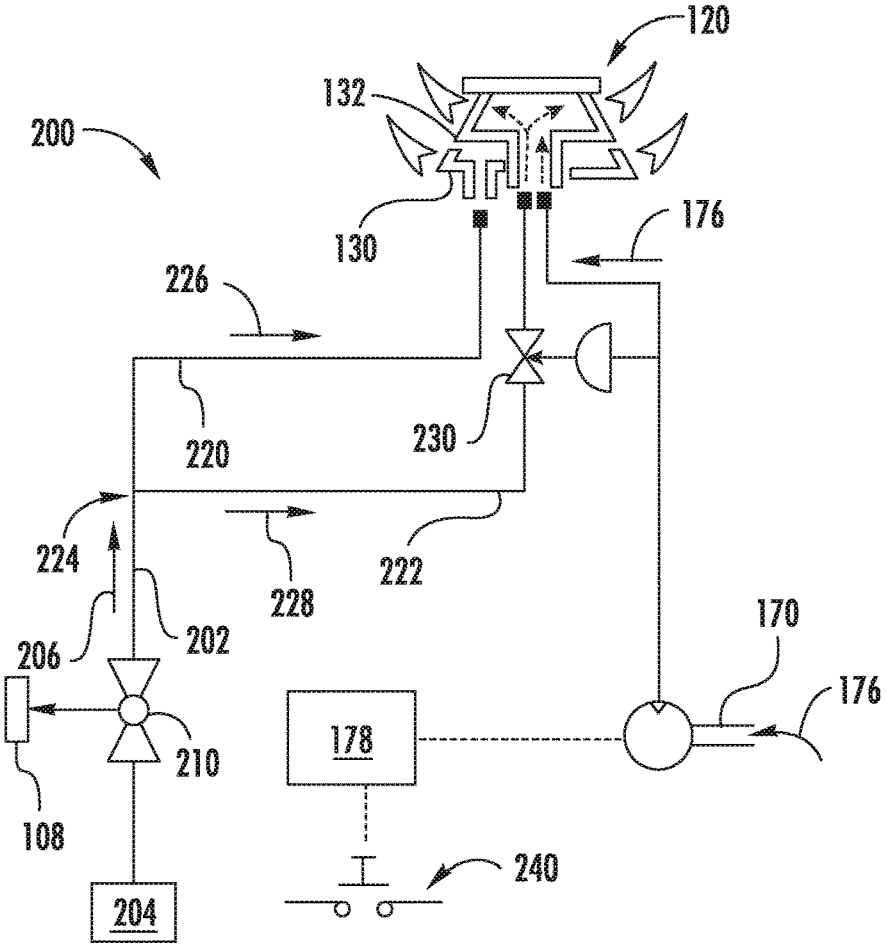
FIG. 8 is a schematic view of a gas burner assembly and a fuel supply system according to another example embodiment of the present subject matter.

As best shown in FIGS. 7 and 8, supply line 202 is split into a first branch (e.g., a primary fuel conduit 220) and a second branch (e.g., a boost fuel conduit 222) at a junction 224, e.g., via a plumbing tee, wye, or any other suitable splitting device. In general, primary fuel conduit 220 extends from junction 224 to first orifice 160, which is positioned for directing a flow of primary fuel 226 into gas burner assembly 120, or more particularly into primary burner 130. Similarly, boost fuel conduit 222 extends from junction 224 to second orifice 172, which is positioned for directing a flow of boost fuel 228 into boost burner 132. Thus, supply line 202 is positioned upstream of primary and boost fuel conduits 220, 222 relative to a flow of gaseous fuel from fuel source 204 and primary and boost fuel conduits 220, 222 may separately supply the gaseous fuel from supply line 202 to primary burner 130 and boost burner 132.

Fuel supply system 200 also includes a boost valve 230 (e.g., such as a solenoid or other suitable valve) operably coupled to boost fuel conduit 222. Boost valve 230 is generally configured for regulating the flow of boost fuel 228 passing through boost fuel conduit 222, as described in detail herein. Specifically, when boost valve 230 is positioned in an open (or substantially open position), the flow of boost fuel 228 is not restricted and is supplied to boost burner stage 132 (e.g., via boost fuel conduit 222), e.g., at a high, fixed rate. In this regard, the flow rate of the flow of boost fuel 228 is directly controlled by control valve 210 and control knob 108. By contrast, when boost valve 230 is positioned in a closed (or substantially closed position), the flow of boost fuel 228 is stopped. It should be appreciated that as used herein, terms of approximation, such as "approximately," "substantially," or "about," refer to being within a ten percent margin of error.

As described above, primary burner 130 is a normally aspirated burner that remains ignited when control knob 108 is in the high position, the medium position, the low position, or any position other than the off position. In addition, primary burner 130 is positioned concentrically around and below boost burner 132. In this manner, primary burner 130 may generally serve as an ignition source for boost burner 132.

As illustrated, boost burner 132 is a forced air or mechanically aspirated burner that is activated only when control knob 108 is in a position other than the off position and boost valve 230 is in the open position (which will be referred to herein as the "boost" position). If control knob 108 is on and boost valve 230 is open, the boost flow of fuel 228 passes through boost fuel conduit 222 to boost burner 132. In this manner, boost burner 132 is a discretely operating (i.e., on or off) auxiliary forced air burner intended for performing high heat operation such as boiling a large pot of water.

Referring again to FIG. 7, fan 170 is operable to flow air 176 into boost burner 132 during the boost mode. In particular, fan 170 may be deactivated and not flow air into boost burner 132 when boost valve 230 is closed. However, fan 170 may be activated and urge air into boost burner 132 when control knob 108 is in any position other than off and the boost mode has been activated. In this regard, the flow of air 176 from fan 170 may facilitate burning of gaseous fuel in boost burner 132. According to an exemplary embodiment, boost valve 230 may be operably coupled to fan 170 such that fan 170 is activated only when boost valve 230 is open (i.e., corresponding to the boost mode). Similarly, fan 170 may be either directly controlled by control knob 108 or may be controlled based on the amount of fuel supplied to obtain the desired air/fuel ratio for combustion. Moreover, according to an exemplary embodiment, fan 170 may run briefly after boost valve 230 is closed, e.g., to purge any fuel within boost fuel chamber 146 or the fuel supply lines.

According to an exemplary embodiment, a flow rate of the flow of fuel in boost fuel conduit 222 is fixed. In addition, an operating speed of fan 170 may be fixed or discrete, e.g., such that a firing rate of boost burner 132 is fixed. Because fan 170 operates only when boost mode is activated, fan 170 may operate at a single speed (e.g., may be a single speed fan). Thus, boost burner 132 may be more easily controlled, e.g., because gas burner assembly 120 does not require a variable speed fan and/or an encoder to track the position of control knob 108. Further, control valve 210 may be a single outlet valve for both primary burner 130 and boost burner 132 and thus reduce a cost and complexity of outlet valve 210 relative to multi-outlet valves.

Figure 9:
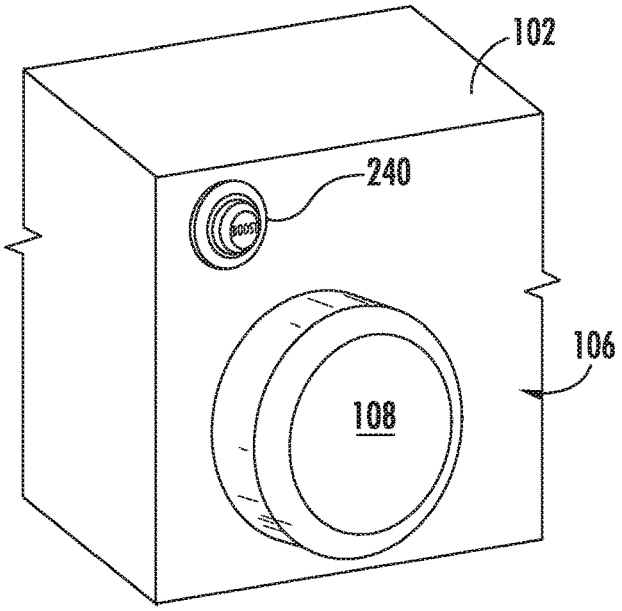
FIG. 9 is a front, elevation view of a knob and a boost button of the example cooktop appliance of FIG. 1.

According to the exemplary embodiment, gas burner assembly 120 may enter the boost mode of operation upon receiving a command, e.g., from controller 178, an electronic circuit, or any other suitable means. For example, according to an exemplary embodiment of the present subject matter, gas burner assembly 120 further includes a boost button 240 (see FIG. 9) which may be pressed to enter the boost mode of operation. In this regard, boost button 240 may be a momentary push button, a toggle switch, or any other suitable button or switch that is operably coupled with controller 178 for providing an indication to gas burner assembly 120 and boost valve 230 to enter boost mode.

As shown in FIG. 7, boost button 240 may be operably coupled to boost valve 230 through controller 178. Thus, when boost button 240 is pressed, controller 178 may open boost valve 230 to start boost mode operation. Fan 170 may generally be configured for operating when boost valve 230 is open, such that a mixed flow of fuel and air may be provided to boost fuel chamber 146. Although controller 178 is illustrated as operating boost valve 230 in FIGS. 7 and 8, it should be appreciated that according to alternative embodiments, a dedicated controller or any other suitable timing device may be used to regulate operation of boost valve 230, as explained more below.

Referring now specifically to FIG. 8, according to an exemplary embodiment of the present subject matter, boost valve 230 is a pressure controlled valve operably coupled with fan 170. Pressure controlled valve is generally configured for stopping the flow of boost fuel 228 when a pressure of the flow of air 176 drops below a predetermined pressure or threshold. The predetermined pressure or threshold may be selected by a user or the manufacturer, may be associated with a specific condition or event, may be selected to correspond to an operating condition of fuel supply system 200, or may be determined in any other suitable manner.

According to an exemplary embodiment, the predetermined pressure is a minimum combustion air threshold pressure, i.e., the pressure generated by a properly operating fan 170 for generating a flow of combustion air 176 for desired combustion. In this regard, if fan 170 fails to provide a flow of combustion air 176 suitable to support operation of boost burner 132, pressure controlled boost valve 230 may sense the low pressure associated with the flow of combustion air 176 and stop the flow of boost fuel 228. Notably, using such a configuration, controller 178 (or another suitable timing device) may be directly coupled to fan 170 and may not need to be operably coupled to boost valve 230.

Now that the construction and configuration of gas burner assembly 120 and fuel supply system 200 have been described according to exemplary embodiments of the present subject matter, an exemplary method 300 for operating a gas burner assembly will be described according to an exemplary embodiment of the present subject matter. Method 300 can be used to operate gas burner assembly 120, or any other suitable heating element or cooktop appliance. In this regard, for example, controller 178 may be configured for implementing some or all steps of method 300. Further, it should be appreciated that the exemplary method 300 is discussed herein only to describe exemplary aspects of the present subject matter, and is not intended to be limiting.

Figure 10:
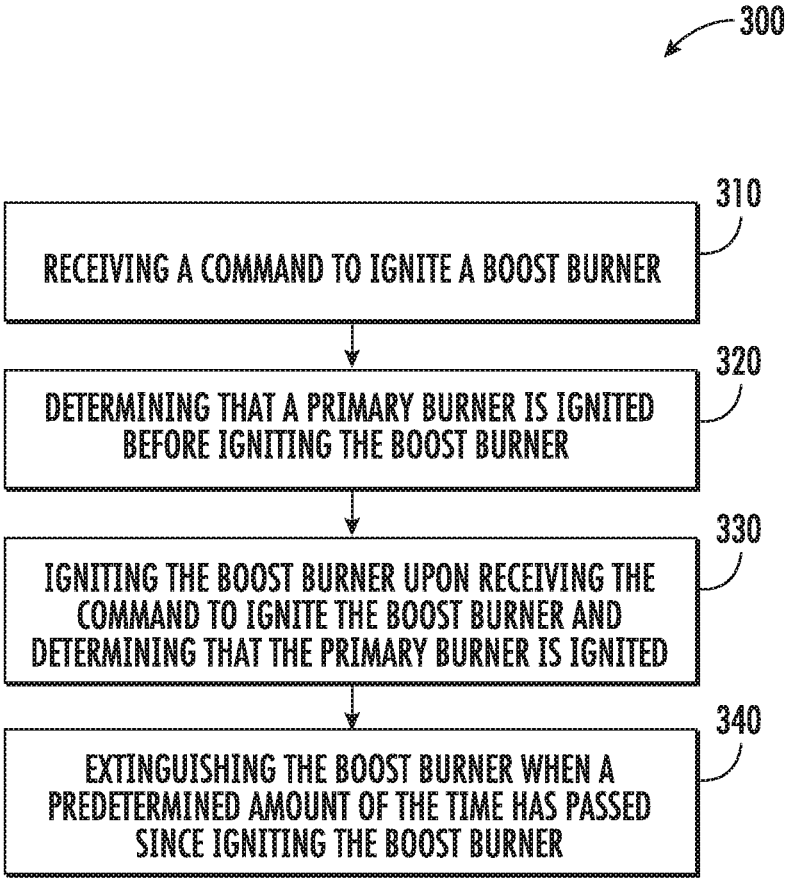
FIG. 10 is a method of operating a gas burner assembly in accordance with one embodiment of the present disclosure.

Referring now to FIG. 10, method 300 includes, at step 310, receiving a command to ignite or activate a boost burner. As explained above, the command to activate the boost burner and enter the boost mode of operation may be received when a boost button (e.g., such as boost button 240) is pressed. Notably, continuing with the exemplary embodiment described above, primary burner 130 may be used to ignite or activate boost burner 132. Therefore, it may be desirable to activate boost mode only when primary burner 130 is ignited. Thus, step 320 includes determining that the primary burner is ignited before igniting the boost burner.

Step 330 includes activating or igniting the boost burner upon receiving the command to ignite the boost burner and determining that the primary burner is ignited. According to an exemplary embodiment, igniting the boost burner includes opening the boost valve to permit the flow of boost fuel into the boost fuel chamber and activating the forced air supply source to urge the flow of air into the boost fuel chamber. According to one exemplary embodiment, a controller or timer board may be operably coupled to the forced air supply source and the boost valve and is configured for both opening/closing boost valve and starting/stopping the forced air supply source.

Method 300 further includes, at step 340, extinguishing the boost burner when a predetermined amount of time has passed since igniting the boost burner. This predetermined amount of time may be set by a user or the manufacturer as a safety feature, e.g., to prevent overheating of foods being cooked or the appliance itself. For example, according to an exemplary embodiment, the predetermined amount of time is approximately ten minutes. Notably, when the predetermined amount of time has expired, the boost burner is shut off and only primary burner may continue to burn. However, if a user desires to continue boost mode, the boost button may be pressed again to restart the time-limited boost mode. In addition, if a user desires to cease operation in the boost mode at any time, the boost mode button may be pressed to toggle in and out of that mode.

According to an exemplary embodiment, extinguishing the boost burner may include closing the boost valve to stop the flow of boost fuel to the boost fuel chamber and deactivating the forced air supply source to stop the flow of air to the boost fuel chamber. According to another exemplary embodiment, the boost valve is a pressure controlled valve operably coupled with the forced air supply source. In this embodiment, the pressure controlled valve is configured for stopping the flow of boost fuel when a pressure of the flow of air drops below a predetermined pressure, such as a minimum combustion air threshold pressure or any other suitable pressure. In such an embodiment, the boost valve need not be directly coupled to a controller or timer board, but instead may rely on the flow of air from the forced air supply source for actuation.

FIG. 10 depicts an exemplary control method having steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of the methods are explained using gas burner assembly 120 and fuel supply system 200 as an example, it should be appreciated that these methods may be applied to the operation of any suitable gas burner assembly or cooktop appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas burner assembly for a cooktop appliance, the gas burner assembly comprising:

a primary burner comprising a plurality of primary flame ports in fluid communication with a primary fuel chamber for receiving a flow of primary fuel;

a boost burner comprising a plurality of boost burner ports in fluid communication with a boost fuel chamber for receiving a flow of boost fuel;

a boost valve for regulating the flow of boost fuel to the boost fuel chamber;

a forced air supply source for selectively urging a flow of air into the boost fuel chamber;

a boost button for generating a command to activate the boost burner; and a controller operably coupled to the boost button, the boost valve, and the forced air supply source, the controller being configured for:

receiving the command to activate the boost burner;

activating the boost burner upon receiving the command to activate the boost burner; and extinguishing the boost burner when a predetermined amount of time has passed since activating the boost burner.

2. The gas burner assembly of claim 1, comprising:

a control valve operably coupled to a fuel supply line for regulating a flow of supply fuel.

3. The gas burner assembly of claim 2, comprising:

a control knob operably coupled to the control valve and being rotatable for controlling a position of the control valve.

4. The gas burner assembly of claim 2, wherein the control valve is generally configured for regulating the flow of primary fuel into the primary fuel chamber and the flow of boost fuel into the boost fuel chamber when the boost valve is open.

5. The gas burner assembly of claim 1, wherein an operating speed of the forced air supply source is fixed and a flow rate of the flow of boost fuel is fixed when the boost valve is open, such that a firing rate of the boost burner ports is fixed.

6. The gas burner assembly of claim 1, wherein the primary flame ports are positioned concentric with and below the boost flame ports.

7. The gas burner assembly of claim 1, wherein the primary flame ports are naturally aspirated.

8. The gas burner assembly of claim 1, wherein the forced air supply source is a fan, an air pump, or an air compressor.

9. The gas burner assembly of claim 1, wherein the controller is further configured for:

determining that the primary burner is ignited before activating the boost burner.

10. The gas burner assembly of claim 1, wherein the boost valve is a pressure controlled valve operably coupled with the forced air supply source, the pressure controlled valve configured for stopping the flow of boost fuel when a pressure of the flow of air drops below a predetermined threshold.

11. A method for operating a gas burner assembly, the gas burner assembly including a primary burner positioned concentrically below a boost burner, a boost valve for regulating a flow of boost fuel to a boost fuel chamber, a boost button, and a forced air supply source for selectively urging a flow of air into the boost fuel chamber, the method comprising:

receiving a command to activate the boost burner, the command to activate the boost burner being received when the boost button is pressed;

activating the boost burner upon receiving the command to activate the boost burner; and extinguishing the boost burner when a predetermined amount of time has passed since activating the boost burner.

12. The method of claim 11, comprising:

determining that the primary burner is ignited before activating the boost burner.

13. The method of claim 11, wherein activating the boost burner comprises:

opening the boost valve to permit the flow of boost fuel into the boost fuel chamber; and activating the forced air supply source to urge the flow of air into the boost fuel chamber.

14. The method of claim 11, wherein extinguishing the boost burner comprises:

closing the boost valve to stop the flow of boost fuel to the boost fuel chamber; and deactivating the forced air supply source to stop the flow of air to the boost fuel chamber.

15. The method of claim 11, wherein the predetermined amount of time is approximately ten minutes.

16. The method of claim 11, further comprising:

receiving a command to turn off the boost burner; and extinguishing the boost burner upon receiving the command to turn off the boost burner.

17. The method of claim 11, wherein the boost valve is a pressure controlled valve operably coupled with the forced air supply source, the pressure controlled valve configured for stopping the flow of boost fuel when a pressure of the flow of air drops below a predetermined threshold.

18. The method of claim 17, wherein the predetermined threshold is less than a minimum combustion airflow threshold.

19. A gas burner assembly for a cooktop appliance, the gas burner assembly comprising:

a primary burner comprising a plurality of primary flame ports in fluid communication with a primary fuel chamber for receiving a flow of primary fuel;

a boost burner comprising a plurality of boost burner ports in fluid communication with a boost fuel chamber for receiving a flow of boost fuel;

a boost valve for regulating the flow of boost fuel to the boost fuel chamber;

a forced air supply source for selectively urging a flow of air into the boost fuel chamber, wherein the boost valve is a pressure controlled valve operably coupled with the forced air supply source, the pressure controlled valve configured for stopping the flow of boost fuel when a pressure of the flow of air drops below a predetermined threshold; and a controller operably coupled to the boost valve and the forced air supply source, the controller being configured for:

receiving a command to activate the boost burner;

activating the boost burner upon receiving the command to activate the boost burner; and extinguishing the boost burner when a predetermined amount of time has passed since activating the boost burner.

* * * * *